US007471911B2

(12) United States Patent
Ide et al.

(10) Patent No.: US 7,471,911 B2
(45) Date of Patent: Dec. 30, 2008

(54) IMAGE FIXING APPARATUS

(75) Inventors: Atsushi Ide, Nara (JP); Koji Aoki, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 145 days.

(21) Appl. No.: 11/490,094

(22) Filed: Jul. 21, 2006

(65) Prior Publication Data

US 2007/0036572 A1 Feb. 15, 2007

(30) Foreign Application Priority Data

Aug. 9, 2005 (JP) ..... 2005-230863

(51) Int. Cl.
*G03G 15/20* (2006.01)

(52) U.S. Cl. ..... 399/69; 399/334

(58) Field of Classification Search ..... 219/216; 399/69, 70, 328, 334
See application file for complete search history.

(56) References Cited

U.S. PATENT DOCUMENTS 6,397,021 B2 * 5/2002 Hayashi et al. ..... 399/69

FOREIGN PATENT DOCUMENTS

| | | | |
|---|---|---|---|
| JP | 5-188824 | A | 7/1993 |
| JP | 8-262920 | A | 10/1996 |
| JP | 2003-043852 | A | 2/2003 |
| JP | 2003-43852 | A | 2/2003 |
| JP | 2003-186345 | A | 7/2003 |

* cited by examiner

*Primary Examiner*—Hoang Ngo
(74) *Attorney, Agent, or Firm*—Birch, Stewart, Kolasch & Birch LLP

(57) ABSTRACT

An embodiment of a fixing apparatus according to the present invention is a fixing apparatus provided with a roller for fixing and a plurality of heat sources that heat a surface of the roller, in which a surface temperature of the roller is detected and controlled at a prescribed temperature while a sheet of recording paper is subjected to pressure and heat by the roller to fix a developer onto the sheet of recording paper, comprising: a plurality of temperature detection means for detecting the surface temperature of the roller, wherein at least one of the temperature detection means is arranged in a position of the roller that does not overlap any of the heat sources when viewed from a peripheral surface side of the roller, or is arranged in a position away from a region of the roller to be controlled at the prescribed temperature.

7 Claims, 7 Drawing Sheets

FIG.5

Tb

| t3 | α |
|---|---|
| 20°C | 1.0 |
| 25°C | 1.04 |
| 30°C | 1.10 |
| | |

IMAGE FIXING APPARATUS

BACKGROUND OF THE INVENTION

This application claims priority under 35 U.S.C. § 119(a) on Patent Application No. 2005-230863 filed in Japan on Aug. 9, 2005, the entire contents of which are hereby incorporated by reference.

The present invention relates to fixing apparatus for fixing a development image onto a sheet of recording paper in electrophotographic image forming apparatuses such as copying machines, facsimile machines, and printers.

In this type of fixing apparatus, a sheet of recording paper is sandwiched between a heating roller and a pressure roller and subjected to heat and pressure, thereby thermally fusing and fixing the development image onto the sheet of recording paper. The surface temperature of the heating roller must be even to uniformly fix the development image onto the sheet of recording paper and it is necessary for substantially the entire heating roller to be heated uniformly.

However, the power consumption of a heater for heating in the fixing apparatus takes up a large proportion of the overall power consumption of the image forming apparatus, and therefore it is necessary to achieve reductions in the power consumption of the heater for heating in the fixing apparatus in order to reduce the power consumption of the image forming apparatus.

For example, in a heating roller of a fixing apparatus of Patent Document 1 (JP H08-262920A), a plurality of heaters are arranged in a line along a lengthwise direction of the heating roller, and the temperature is raised in only the heaters for heating required to heat surface portions of the heating roller that contact the sheet of recording paper for each sheet of recording paper of various widths, which avoids increasing the amount of heat produced by unneeded heaters, thereby reducing power consumption. Also, a plurality of temperature sensors for detecting the surface temperature of the heating roller in a plurality of locations are provided in order to control the heat produced by the plurality of heaters.

The temperature sensors are thermistors for example and, as disclosed in Patent Document 1 and Patent Document 2 (JP H05-188824A), it is common for the temperature sensors to be made to contact the surface of the heating roller to detect the surface temperature of the heating roller.

On the one hand, since only black developer is used in the case of monochrome images, a developer layer of a monochrome image on a sheet of recording paper is as thin as 20 to 30 μm. In contrast to this, since a color image is formed by superimposing a plurality of colors of developer onto a sheet of recording paper in the case of color images, a developer layer of a color image on a sheet of recording paper becomes as thick as 50 to 80 μm.

For this reason, for monochrome images, a nip region is formed between a metal heating roller coated in Teflon (registered trademark) or titanium and a pressure roller covered by a $SiO_2$ rubber for example, and even though a developer layer can be fixed onto a sheet of recording paper with this nip region, a developer layer of a color image cannot be fixed sufficiently with this nip region.

This is because although it is necessary for the heat of the heating roller to be transmitted sufficiently to the developer layer of a color image in order to thermally fuse the develop layer more than when thermally fusing the developer layer of a monochrome image since the developer layer of a color image is thick, the heat of the heating roller cannot be transmitted sufficiently to the developer layer with the above-described nip region.

Accordingly, in a fixing apparatus for a color image, the surfaces of both the heating roller and the pressure roller are covered with a $SiO_2$ rubber, which thereby achieves an increase in the width of the nip region. With a nip region whose width has been increased, the surface area of the sheet of recording paper that contacts the heating roller is increased, and therefore the heat of the heating roller is sufficiently transmitted to the developer layer on the sheet of recording paper and fixing can be achieved sufficiently by reliably carrying out thermal fusing of the developer layer.

However, by having the temperature sensors come in contact with the surface of the heating roller to control the surface temperature of the heating roller in this color image forming apparatus, damage is caused to the surface of the heating roller by contact with the temperature sensors since the surface of the heating roller is a $SiO_2$ rubber, thus causing unevenness in the fixing.

In particular, since there has been a call for increased printing speed in color image forming apparatuses in recent years and the rotational velocity of the heating roller and the pressure roller in fixing apparatus has been increased, there has been a tendency for more damage to occur on the surface of the heating roller due to contact with the temperature sensors and this has become a cause of reduced image quality.

For this reason, non-contact type temperature sensors have been employed that are capable of detecting the temperature of the heating roller surface without making contact with the surface. However, these non-contact type temperature sensors are large compared with contact-type temperature sensors.

Increasing the size of the heating roller temperature sensors is not desirable due to the advancement of miniaturization of color image forming apparatuses. Providing such large non-contact type temperature sensors in a plurality of locations to detect the surface temperature of the heating roller in the respective locations as described above would require a large space inside the fixing apparatus, which would increase the size of the fixing apparatus, and therefore in turn lead to an increase in size of the color image forming apparatus.

SUMMARY OF THE INVENTION

The present invention has been devised in consideration of the conventional problems described above, and it is an object thereof to provide a fixing apparatus in which contact-type temperature sensors can be applied even when the surfaces of the heating roller and the pressure roller are easily damageable.

The present invention has been devised in consideration of the conventional problems described above, and it is an object thereof to provide a fixing apparatus in which contact-type and/or non-contact type temperature sensors can be applied and that is capable of miniaturization.

In order to solve these issues, in the present invention, a fixing apparatus provided with a roller for fixing and a plurality of heat sources that heat a surface of the roller, in which a surface temperature of the roller is detected and controlled at a prescribed temperature while a sheet of recording paper is subjected to pressure and heat by the roller to fix a developer onto the sheet of recording paper, comprises: a plurality of temperature detection means for detecting the surface temperature of the roller, wherein at least one of the temperature detection means is arranged in a position of the roller that does not overlap any of the heat sources when viewed from a peripheral surface side of the roller.

Another aspect of the present invention is a fixing apparatus provided with a roller for fixing and a plurality of heat sources that heat a surface of the roller, in which a surface temperature of the roller is detected and controlled at a prescribed temperature while a sheet of recording paper is subjected to pressure and heat by the roller to fix a developer onto the sheet of recording paper, comprises: a plurality of temperature detection means for detecting the surface temperature of the roller, wherein at least one of the temperature detection means is arranged in a position away from a region of the roller to be controlled at the prescribed temperature.

Furthermore, in the present invention, the temperature detection means arranged at the position is arranged in contact with the roller surface.

Further still, in the present invention, the position is a position away from a fixing region of a sheet of recording paper using the roller.

Furthermore, in the present invention, the heat sources include a first heat source that heats a central area in a lengthwise direction of the roller and a second heat source that heats both sides of the central area of the roller, and control means is provided for controlling the second heat source by performing correction on a temperature detected by the temperature detection means arranged in the position and determining a temperature of a region of the roller to be controlled to the prescribed temperature, wherein the second heat source is controlled based on the temperature determined by the correction.

Further still, in the present invention, the temperature detection means arranged at the region of the roller to be controlled to the prescribed temperature is arranged not contacting the roller surface.

With the present invention, a plurality of temperature detection means are provided for detecting the surface temperature of the roller, wherein at least one of the temperature detection means is arranged in a position of the roller that does not overlap any of the heat sources when viewed from a peripheral surface side of the roller, or arranged in a position away from a region of the roller to be controlled at the prescribed temperature. In such positions, there is no fixing of developer onto the sheet of recording paper and these positions are outside the fixing region of the sheet of recording paper using the roller, and therefore it is acceptable for the temperature detection means to contact the surface of the roller and the surface of the roller to be damaged by the temperature detection means. For this reason, contact type components that contact the surface of the roller may be used as the temperature detection means arranged in the aforementioned position.

Since such contact type temperature detection means are small sized, it is possible to avoid increasing the size of the fixing apparatus and the color image forming apparatus when compared to using large non-contact type components for all the temperature detection means.

For example, the heat sources may include a first heat source that heats a central area in a lengthwise direction of the roller and a second heat source that heats both sides of the central area of the roller. When the width of the sheet of recording paper is narrow, even when only the first heat source is caused to increase in temperature to heat only a central region of the roller corresponding to the width of the sheet of recording paper, the entire sheet of recording paper can be uniformly heated. Also, when the width of the sheet of recording paper is wide, by setting the first and second heat source to increase in temperature so that substantially the entire roller is heated to achieve a uniform surface temperature, the entire sheet of recording paper can be uniformly heated. By using the second heat source to increase the temperature only when the width of the sheet of recording paper is wide, the power consumption of the fixing apparatus can be reduced.

Then, the temperature detection means arranged in the aforementioned position does not directly measure the temperature of the region of the roller to be controlled at the prescribed temperature, but detects the temperature around that region. Accordingly, the temperature detected by this temperature detection means is corrected and the temperature of the region is determined. Further still, since the second heat source is controlled based on the temperature determined by correction in this manner, the surface temperatures on both sides of the central area of the roller can be controlled accurately, and the entire roller surface can be set to a uniform temperature.

Furthermore, the temperature detection means arranged at the region of the roller to be controlled to the prescribed temperature is arranged not contacting the roller surface. Consequently, in the fixing region of the sheet of recording paper using the roller, the temperature detection means does not contact the surface of the roller and there is no damage to the roller surface caused by contact with the temperature detection means. Thus, there is no unevenness in fixing caused by damage to the roller surface in regions where the roller can be set at the prescribed temperature.

BRIEF DESCRIPTION OF THE DRAWINGS

FIG. 5 conceptually illustrates a data table in which surface temperatures of an end portion of the heating roller and a ratio are associated.

DESCRIPTION OF THE PREFERRED EMBODIMENTS

Hereinafter, embodiments of the present invention will be described in detail with reference to the accompanying drawings.

Figure 1:
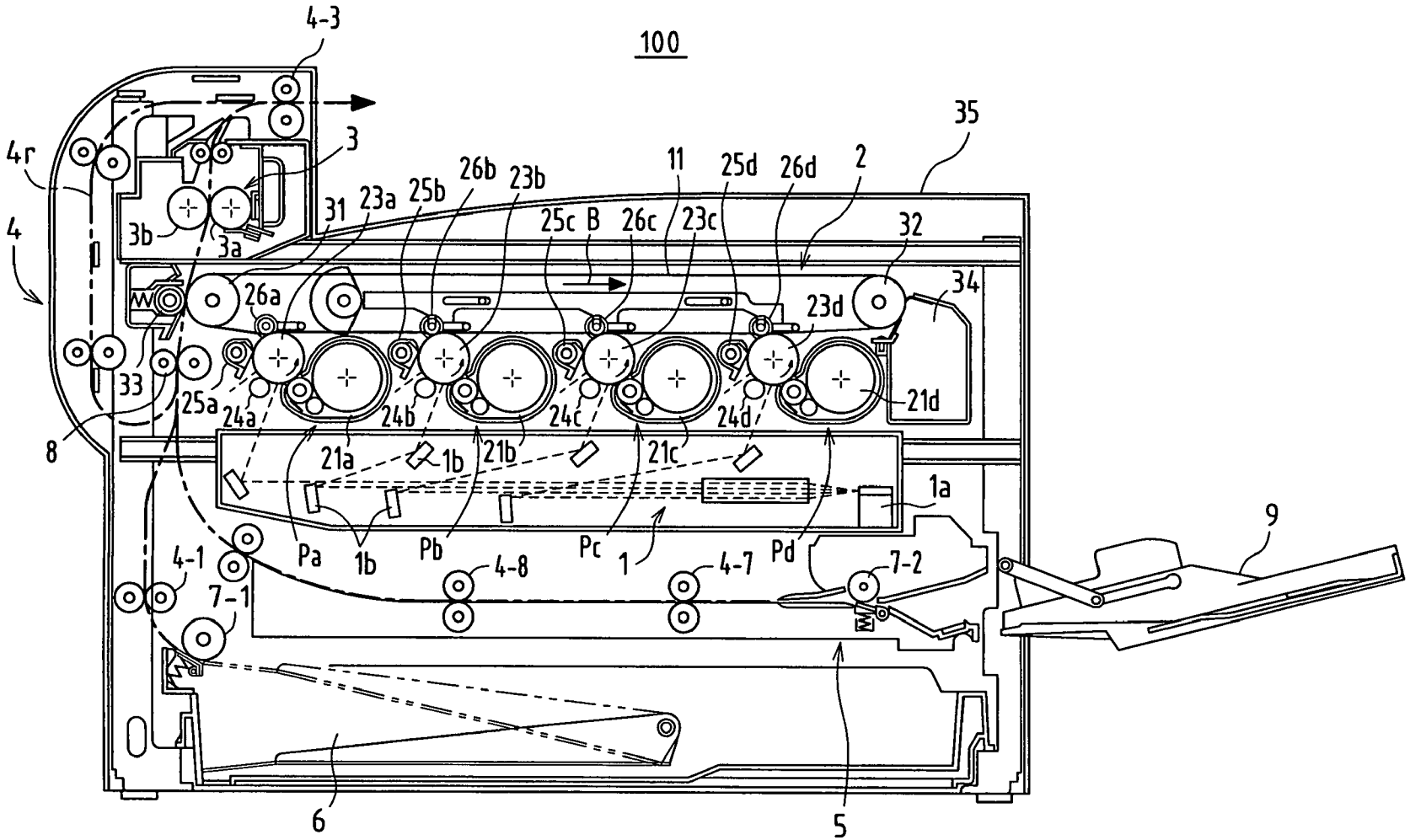
FIG. 1 is a lateral view showing an image forming apparatus to which an embodiment of a fixing apparatus according to the present invention has been applied.

FIG. 1 is a lateral view showing an image forming apparatus to which an embodiment of a fixing apparatus according to the present invention has been applied. An image forming apparatus 100 is a color laser printer that records a color image on a sheet of recording paper and is provided with an exposure device 1, image forming stations Pa, Pb, Pc, and Pd, an intermediate transfer belt device 2, a fixing apparatus 3, a paper transport system 4, and a paper supply device 5, for example.

The image forming stations Pa, Pb, Pc, and Pd respectively form toner images of black (K), cyan (C), magenta (M), and yellow (Y), and the toner image of each color is transferred to an intermediate transfer belt 11 of the intermediate transfer belt device 2. The image forming stations Pa, Pb, Pc, and Pd are provided with items including developing devices 21*a* to 21*d*, photosensitive drums 23*a* to 23*d*, chargers 24*a* to 24*d*, and cleaning devices 25*a* to 25*d*.

The photosensitive drums 23*a* to 23*d* press on respective primary transfer rollers 26*a* to 26*d* via the intermediate transfer belt 11 and rotate with the intermediate transfer belt 11 at a peripheral speed equivalent to the intermediate transfer belt 11, which rotationally moves in the direction of arrow B. Furthermore, the primary transfer rollers 26*a* to 26*d* also rotate following the intermediate transfer belt 11 at a peripheral speed equivalent to the intermediate transfer belt 11, which rotationally moves in the direction of arrow B.

The chargers 24*a* to 24*d* are roller-type or brush-type devices that contact the photosensitive drums 23*a* to 23*d*, or charger-type devices, and uniformly charge the surfaces of the photosensitive drums 23*a* to 23*d*.

The exposure device 1 is provided with a laser light source 1*a* that irradiates laser light toward the respective photosensitive drums 23*a* to 23*d* and a plurality of mirrors 1*b* that guide the laser light onto the respective photosensitive drums 23*a* to 23*d*, for example. The laser lights are irradiated onto the surfaces of the respective photosensitive drums 23*a* to 23*d* while being modulated in accordance with the image data, such that respective electrostatic latent images are formed on the surfaces of the photosensitive drums 23*a* to 23*d*.

It should be noted that a writing head in which light-emitting elements such as ELs and LEDs are arranged in an array may be used as the exposure device 1.

The developing devices 21*a* to 21*d* hold the respective color toners and form toner images of these respective colors on the surfaces of the photosensitive drums 23*a* to 23*d* by causing toner of these respective colors to adhere to the electrostatic latent images on the photosensitive drums 23*a* to 23*d*. These toner images are transferred from the photosensitive drums 23*a* to 23*d* to the intermediate transfer belt 11 and superimposed there.

The intermediate transfer belt device 2 is provided with items such as the intermediate transfer belt 11, the primary transfer rollers 26*a* to 26*d*, a drive support roller 31, an idler support roller 32, and a secondary transfer roller 33. The intermediate transfer belt 11 is rotatably supported by being wound around the drive support roller 31 and the idler support roller 32, and the primary transfer rollers 26*a* to 26*d* and the secondary transfer roller 33 are pressed against the intermediate transfer belt 11.

The intermediate transfer belt 11 is made of a synthetic resin film of a thickness in the range of 100 μm to 150 μm for example. The secondary transfer roller 33 is supported so as to be movable laterally, and when it is moved rightward it sandwiches the intermediate transfer belt 11 between the drive support roller 31 and forms a nip region. The drive support roller 31 fulfills a role of being a backup roller of the secondary transfer roller 33 and rotates in the downstream of the respective nip regions between the primary transfer rollers 26*a* to 26*d* and the photosensitive drums 23*a* to 23*d* so that the intermediate transfer belt 11 is pulled and made to rotationally move in the B arrow direction. Thus, the nip regions are maintained stably.

It should be noted that, of the primary transfer rollers 26*a* to 26*d* and the photosensitive drums 23*a* to 23*d*, it is preferable for one of these to be formed of a hard material and the other to be formed of a flexible material in order to more stably form the respective nip regions between the primary transfer rollers 26*a* to 26*d* and the photosensitive drums 23*a* to 23*d*.

Each of the primary transfer rollers 26*a* to 26*d* is made of, for example, a metal shaft of a diameter in the range of 8 mm to 10 mm, the circumference of which is covered by a conductive elastic material (such as EPDM and urethane foam). With the intermediate transfer belt 11 sandwiched in the nip regions between the primary transfer rollers 26*a* to 26*d* and the photosensitive drums 23*a* to 23*d*, a bias voltage having a polarity inverse to the charged polarity of the toner is applied to the primary transfer rollers 26*a* to 26*d* such that the respective electrical fields are effected to the toner on the surfaces of the photosensitive drums 23*a* to 23*d* through intermediate transfer belt 11, after which the toner on the surfaces of the photosensitive drums 23*a* to 23*d* is attracted and transferred to the intermediate transfer belt 11. Thus, the toner images of these colors are transferred to the intermediate transfer belt 11 and superimposed there.

It should be noted that brushes or the like may be used instead of rollers as the primary transfer rollers 26*a* to 26*d*.

A cleaning apparatus 34 includes, for example, a cleaning blade that slides in contact with the surface of the intermediate transfer belt 11, and removes toner remaining on the surface of the intermediate transfer belt 11 to prevent such defects as fogging of the next image to be printed.

In this way, the color toner images that are transferred and superimposed onto the intermediate transfer belt 11 are transported to the nip region between the drive support roller 31 and the secondary transfer roller 33 along with the rotational movement of the intermediate transfer belt 11. Then, the leading edge of the sheet of recording paper carried by register rollers 8 is aligned with the leading edge of the color toner images on the intermediate transfer belt 11, and the color toner images and the sheet of recording paper are overlaid so that the color toner images are transferred to the sheet of recording paper.

After this, the sheet of recording paper is carried to the fixing apparatus 3 and is here sandwiched between a heating roller 3*a* and a pressure roller 3*b*. Thus, the color toners on the sheet of recording paper are thermally fused and mixed so that the color toner images are fixed to the sheet of recording paper as a color image.

The sheet of recording paper is carried to the paper discharge tray 35 by the paper transport system 4 and discharged here facedown.

On the other hand, sheets of recording paper are stacked and stored in the paper supply cassette 6 in the image forming apparatus 100. In the paper transport system 4, sheets of recording paper are drawn out sheet by sheet from the paper supply cassette 6 by a pickup roller 7-1 and the sheets of recording paper are carried to the register rollers 8 by carry rollers 4-1.

Alternatively, sheets of recording paper are loaded into a manual paper supply tray 9. In the paper supply device 5, a sheet of recording paper is drawn out from the manual paper supply tray 9 by a pickup roller 7-2 and the sheet of recording paper is carried to the register rollers 8 of the paper transport system 4 by carry rollers 4-7 and 4-8.

In the paper transport system 4, the sheet of recording paper is temporarily stopped by the register rollers 8, the leading edge of the sheet of recording paper is aligned, then the sheet of recording paper is carried to the secondary transfer roller 33 by the register rollers 8 with a timing in which the leading edge of the sheet of recording paper is superimposed on the leading edge of the toner image formed on the intermediate transfer belt 11 of the intermediate transfer belt device 2.

It should be noted that it is also possible to use only the image forming station Pa to form a monochrome image and transfer the monochrome image to the intermediate transfer belt 11 of the intermediate transfer belt device 2. As with the color image, the monochrome image is transferred from the intermediate transfer belt 11 to the sheet of recording paper and fixed to the sheet of recording paper.

Furthermore, when carrying out printing not only on the front surface of the sheet of recording paper but on both surfaces, after the image on the front surface of the sheet of recording paper is fixed by the fixing apparatus 3 and while carry rollers 4-3 of the paper transport system 4 are carrying the sheet of recording paper, the carry rollers 4-3 can be made to stop and then rotate in reverse. The front and back of the sheet of recording paper are inverted via an inversion route 4*r* of the paper transport system 4, and the sheet of recording paper is guided to the register rollers 8 and an image is recorded and fixed on the back side of the sheet of recording paper in the same way as the front side of the sheet of recording paper, after which the sheet of recording paper is discharged to the paper discharge tray 35.

Figure 2:
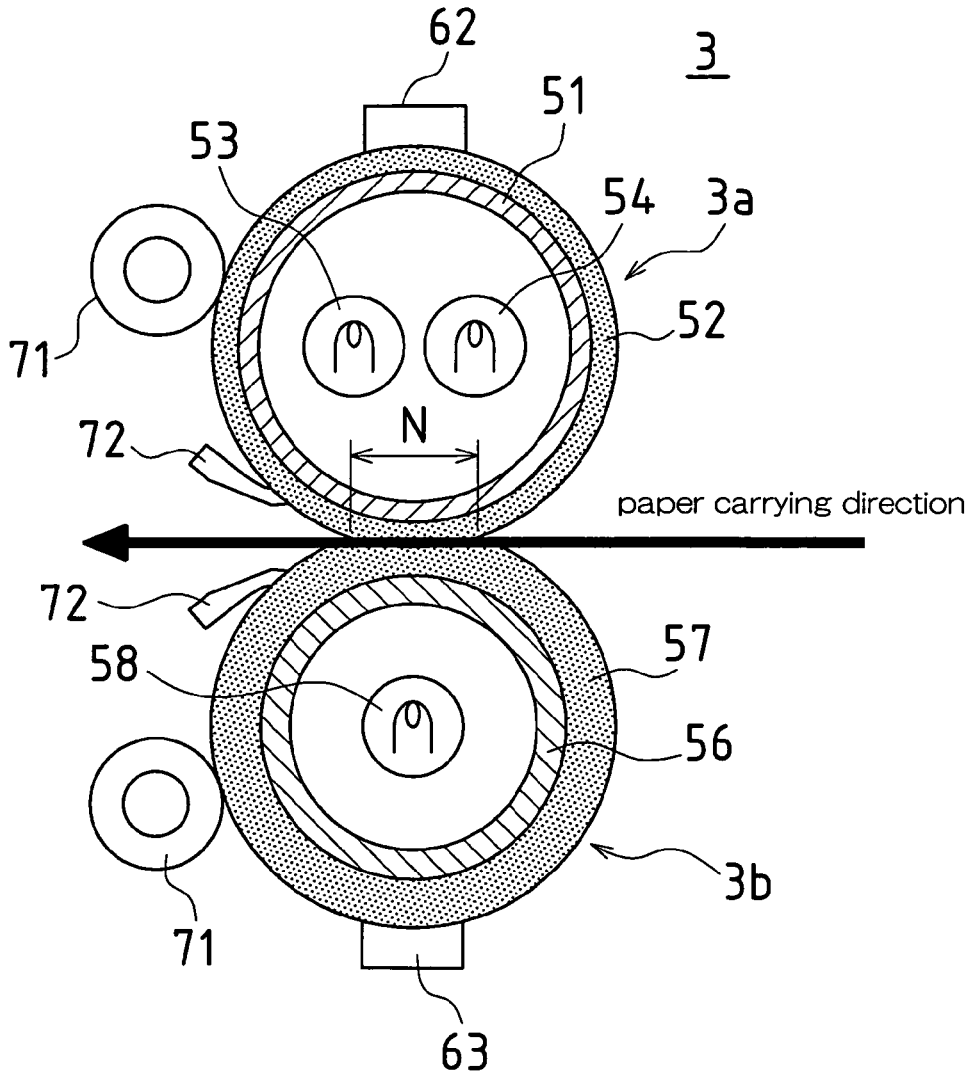
FIG. 2 is a lateral cross-section showing a vertical direction cutaway view of a heating roller and a pressure roller of the fixing apparatus according to the present embodiment.
Figure 3:
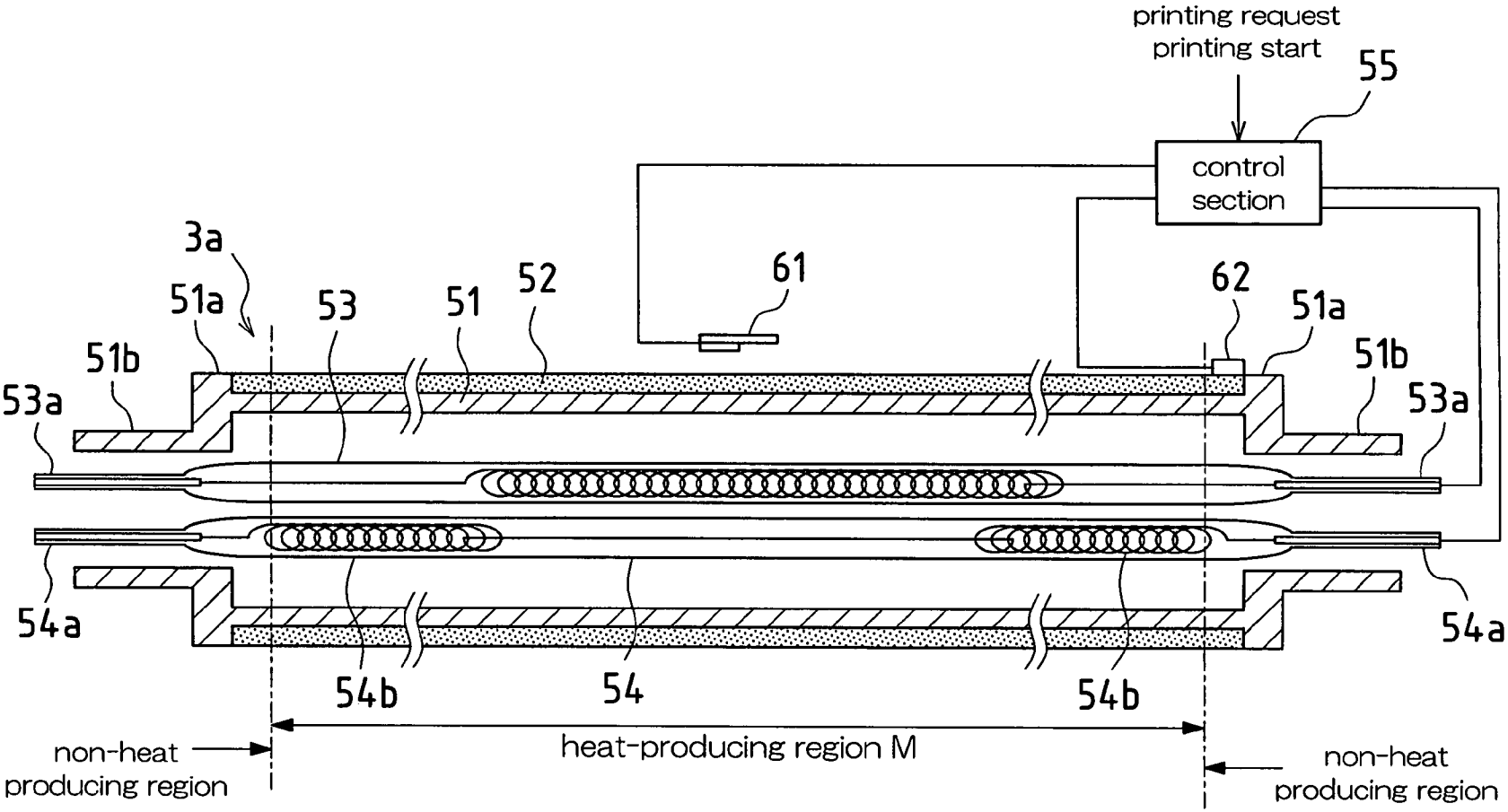
FIG. 3 is a vertical cross-section showing a horizontal direction cutaway view of the heating roller of the fixing apparatus of FIG. 2.

The following is a detailed description of the fixing apparatus 3 of the present embodiment. FIG. 2 is a lateral cross-section showing a vertical direction cutaway view of the heating roller 3*a* and the pressure roller 3*b* of the fixing apparatus 3 and FIG. 3 is a vertical cross-section showing a horizontal direction cutaway view of the heating roller 3*a* of the fixing apparatus 3.

In the fixing apparatus 3 of the present embodiment, the heating roller 3*a* and the pressure roller 3*b* are rotatably supported on shafts and are pressing against each other such that a nip region N is formed in which a sheet of recording paper is sandwiched between the heating roller 3*a* and the pressure roller 3*b*. A sheet of recording paper is guided into the nip region N between the heating roller 3*a* and the pressure roller 3*b* by one of the rollers 3*a* and 3*b* being rotationally driven and the other being driven as a follower, such that pressure and heat are applied to the sheet of recording paper by the rollers 3*a* and 3*b*. Thus, as described earlier, the color toners on the sheet of recording paper are thermally fused and mixed so that the color toner images are fixed to the sheet of recording paper as a color image.

Furthermore, cleaning rollers 71 and 71 press against the heating roller 3*a* and the pressure roller 3*b* respectively to remove such substances as toner and paper debris adhering to the surfaces of the rollers 3*a* and 3*b*.

Further still, paper separating claws 72 and 72 press against the heating roller 3*a* and the pressure roller 3*b* respectively to take off sheets of recording paper from the surfaces of the rollers 3*a* and 3*b* and prevent sheets of recording paper from winding around the rollers 3*a* and 3*b*.

The heating roller 3*a* is a component in which a peripheral surface of a metal cylinder 51 is covered in an elastic layer 52 made of a $SiO_2$ rubber. Collars 51*a* are provided at both ends of the cylinder 51 and the elastic layer 52 is arranged between the collars 51*a*. Furthermore, pipe shafts 51 are provided protruding from the center of the collars 51*a* of the cylinder 51 and these pipe shafts 51*b* are rotatably supported. Further still, a main heater 53 and a sub-heater 54 are arranged inside the cylinder 51 along a lengthwise direction of the heating roller 3*a* and the heating roller 3*a* is heated by the heat produced by the main heater 53 or the sub-heater 54. Terminals 53*a* at the ends of the main heater 53 and terminals 54*a* at the ends of the sub-heater 54 are connected to a control section 55 through the pipe shafts 51*b*.

Figure 4:
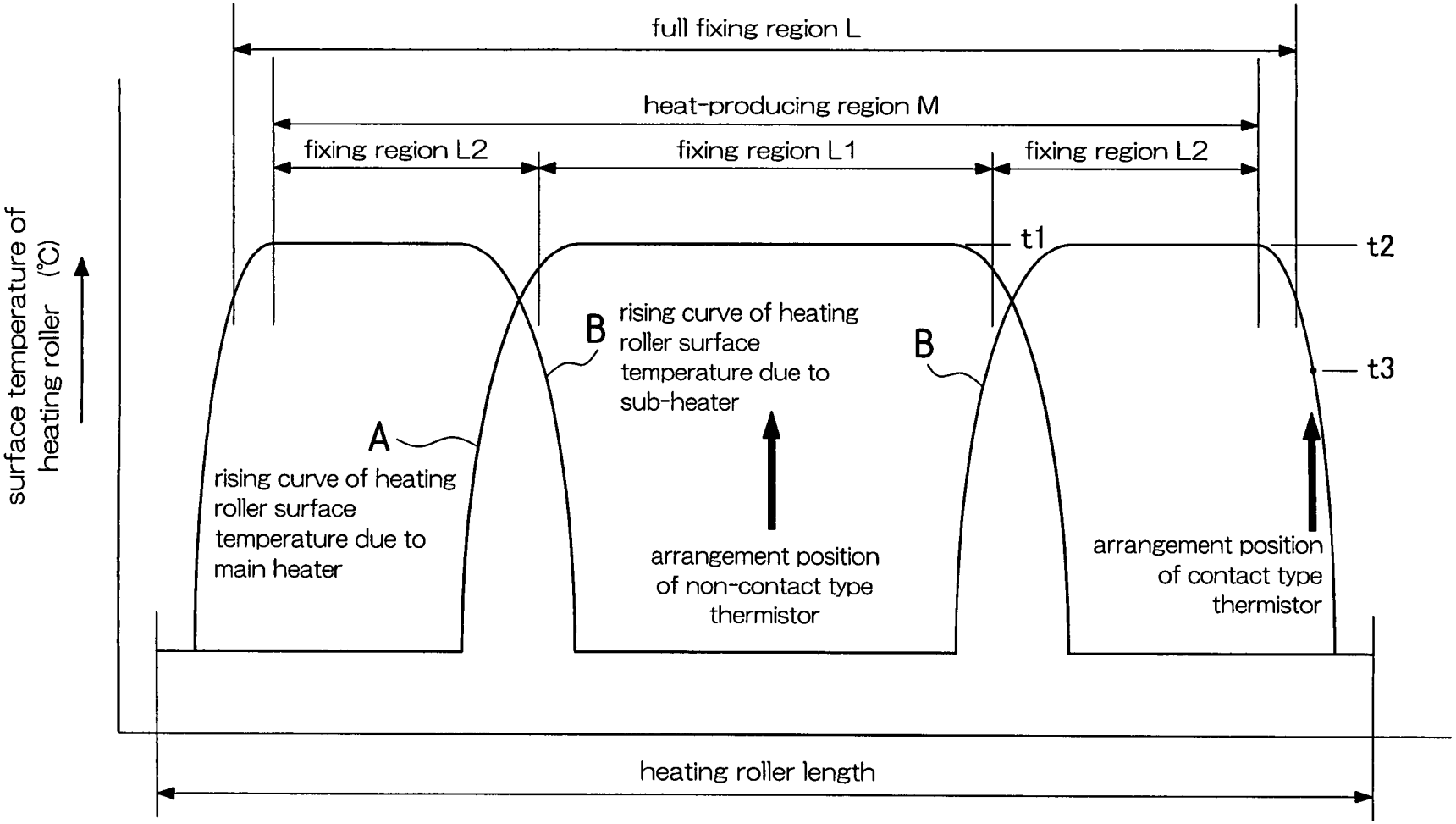
FIG. 4 is a graph illustrating temperature distribution characteristics A of the heating roller heated by the main heater and temperature distribution characteristics B of the heating roller heated by the sub-heater.

FIG. 4 is a graph illustrating temperature distribution characteristics A of the heating roller 3*a* heated by the main heater 53 and temperature distribution characteristics B of the heating roller 3*a* heated by the sub-heater 54. The main heater 53 is arranged at a central vicinity of the heating roller 3*a* and heats the heating roller 3*a* at a fixing region L1 at this central vicinity. When the heating roller 3*a* is heated by only the main heater 53, the surface temperature of the heating roller 3*a* rises uniformly at the fixing region L1 of the central vicinity, and the surface temperature of the heating roller 3*a* is lower at both ends for further distances from the fixing region L1.

Furthermore, the sub-heater 54 has two heater sections 54*b* and 54*b* and these heater sections 54*b* are distributed and arranged at the ends of the heating roller 3*a* such that the heating roller 3*a* is heated at two end side fixing regions L2. When the heating roller 3*a* is heated by only the heater sections 54*b*, the surface temperature of the heating roller 3*a* rises uniformly at the two end side fixing regions L2, and the surface temperature of the heating roller 3*a* is lower for further distances from these fixing regions L2.

Accordingly, when only the main heater 53 produces heat, the surface temperature of the heating roller 3*a* is uniform at only the fixing region L1 with the temperature distribution characteristics A.

Furthermore, when the sub-heater 54 produces heat, the main heater 53 is also always made to produce heat. Thus, the surface temperature of the heating roller 3*a* becomes uniform at a full fixing region L, which includes the fixing region L1 and the fixing regions L2. As shown in FIG. 4, when viewed from the peripheral surface of the heating roller 3*a*, the full fixing region L is slightly wider than a heat-producing region M where the main heater 53 and the sub-heater are present.

When fixing the color toners on the sheet of recording paper, the surface temperature of the heating roller 3*a* at the fixing region L1, or the surface temperature of the heating roller 3*a* at the full fixing region L, is maintained at a prescribed temperature T1. By maintaining the surface temperature of the heating roller 3*a* at the prescribed temperature T1, the color toners are suitably heated and fused to be fixed onto the sheet of recording paper.

Similar to the heating roller 3*a*, the pressure roller 3*b* is also a component in which a peripheral surface of a metal cylinder 56 is covered in an elastic layer 57 made of a $SiO_2$ rubber. Similar to the cylinder 51 of the heating roller 3*a*, the cylinder 56 has collars (not shown in drawings) at both ends and pipe shafts (not shown in drawings), and the pipe shafts are rotatably supported. Furthermore, a single heater 58 is arranged inside the cylinder 56 along a lengthwise direction of the pressure roller 3*b* and the pressure roller 3*b* is heated by the heat produced by the heater 58. Terminals at the ends of the heater 58 are also connected to the control section 55 through the pipe shafts at the ends of the cylinder 56.

The heater 58 heats substantially the entire pressure roller 3*b* and the surface temperature of the pressure roller 3*b* is made to rise uniformly in the full fixing region L shown in FIG. 4.

When fixing the color toners on the sheet of recording paper, the surface temperature of the pressure roller 3*b* of the full fixing region L is maintained at the same prescribed temperature T1 as the heating roller 3*a*. By maintaining the surface temperature of the pressure roller 3*b* at the prescribed temperature T1, the sheet of recording paper is heated and the fixing properties of the toner with respect to the sheet of recording paper are improved.

Next, a non-contact type thermistor 61 is arranged at a location slightly apart from the surface of the elastic layer 52 of the heating roller 3*a* at substantially the central vicinity of the heating roller 3*a*. Also, a contact type thermistor 62 is arranged in contact with an end portion of the elastic layer 52 of the heating roller 3*a*. As shown in FIG. 3, when viewed from the peripheral surface of the heating roller 3*a*, this end portion of the heating roller 3*a* corresponds to a location where the end portion does not overlap the main heater 53 nor the sub-heater, that is, a location further outside from the heat-producing region M.

Two thermistor elements are mounted inside the non-contact type thermistor 61. The surface temperature of the elastic layer 52 of the heating roller 3*a* is detected by one of the thermistor elements and the temperature of the non-contact type thermistor 61 is detected by the other thermistor element, and detection output indicating the surface temperature of the elastic layer 52 and the temperature of the non-contact type thermistor 61 respectively is outputted to the control section 55. The control section 55 determines a surface temperature t1 of the heating roller 3*a* at the fixing region L1 based on the two items of detection output from the non-contact type thermistor 61.

Furthermore, the contact type thermistor 62 directly detects the surface temperature of the end portion of the elastic layer 52 of the heating roller 3*a*. However, as is evident from the temperature distribution characteristics B shown in FIG. 4, at the end portion of the elastic layer 52 of the heating roller 3*a*, a surface temperature t3 of the end portion is lower than a surface temperature t2 of the fixing regions L2. Consequently, the control section 55 corrects the surface temperature t3 of the end portion indicated by the detection output of the contact type thermistor 62 and determines the surface temperature t2 of the fixing regions L2.

For example, while the main heater 53 and the sub-heater 54 of the heating roller 3*a* are caused to produce heat and the surface temperature of the heating roller 3*a* is gradually raised from a normal temperature, the surface temperature t3 of the end portion of the heating roller 3*a* and the surface temperature t2 of the fixing regions L2 are measured, and each time the surface temperature t3 of the end portion of the heating roller 3*a* incrementally changes, a ratio $\alpha$ between the surface temperature t3 of the end portion and the surface temperature t2 of the fixing regions L2 is obtained. A data table Tb is created in advance in which the surface temperature t3 of the end portion and the ratio $\alpha$ are associated as shown in FIG. 5, and this data table Tb is stored in the control section 55.

When the main heater 53 and the sub-heater 54 produce heat, the control section 55 searches the data table Tb for the ratio $\alpha$ that corresponds to the surface temperature t3 of the end portion indicated by the detection output of the contact type thermistor 62 and multiplies the surface temperature t3 by this ratio $\alpha$ to determine the temperature t2 of the fixing regions L2.

Here, reductions in the surface temperature of the end portion of the heating roller 3*a* are caused by such factors as direct heat release from the heating roller 3*a* and by heat release due to thermal conduction from the heating roller 3*a* to surrounding members. The amount of heat released is substantially specified and therefore the temperature t2 of the fixing regions L2 can be determined based on the ratio $\alpha$ with the surface temperature t3 of the end portion of the heating roller 3*a* using the data table Tb as described above.

The non-contact type thermistor 61 is arranged slightly apart from the surface of the elastic layer 52 of the heating roller 3*a* in the fixing region L1, and therefore there is no damage to the surface of the elastic layer 52. Furthermore, by arranging the contact type thermistor 62 in contact with the end portion of the elastic layer 52 of the heating roller 3*a* away from the full fixing region L, this end portion has no effect on the fixing of the toner onto the sheet of recording paper and even if the end portion is damaged by contact with the contact type thermistor 62, damage to the end portion does not become a cause of unevenness of fixing on the sheet of recording paper.

Furthermore, since only one large non-contact type thermistor 61 is used in combination with the small contact type thermistor 62, it is possible to avoid increasing the size of the fixing apparatus 3 as well as the image forming apparatus 100.

On the other hand, a contact type thermistor 63 is arranged in contact with a central vicinity of the elastic layer 57 of the pressure roller 3*b*. The contact type thermistor 63 directly detects the surface temperature of the central vicinity of the elastic layer 57. Furthermore, as mentioned earlier, the heater 58 of the pressure roller 3*b* uniformly raises the surface temperature of the pressure roller 3*b* in the full fixing region L. Consequently, the control section 55 can determine the surface temperature of the pressure roller 3*b* indicated by the detection output of the contact type thermistor 63 as the surface temperature of the full fixing region L.

It should be noted that even if the elastic layer 57 of the pressure roller 3*b* is damaged by contact with the contact type thermistor 63, the pressure roller 3*b* heats the sheet of recording paper only and does not directly heat the toner on the sheet of recording paper, and therefore damage on the elastic layer 57 of the pressure roller 3*b* does not become a cause of unevenness in the fixing of the sheet of recording paper.

In a fixing apparatus 3 configured in this manner, the surface temperature of the heating roller 3*a* and the surface temperature of the pressure roller 3*b* are kept below the prescribed temperature T1 during standby mode or power saving mode of the image forming apparatus 100.

That is, the control section 55 determines the surface temperature t1 of the heating roller 3*a* in the fixing region L1 from the detection output of the non-contact type thermistor 61 and controls the ON/OFF of powering to the main heater 53 of the heating roller 3*a* so that the surface temperature t1 is a constant temperature below the prescribed temperature T1, and also determines the surface temperature t2 of the heating roller 3*a* in the fixing regions L2 from the detection output of the contact type thermistor 62 and controls the ON/OFF of powering to the sub-heater 54 of the heating roller 3*a* so that the surface temperature t2 is a constant temperature below the prescribed temperature T1. Similarly, the control section 55 controls the ON/OFF of powering to the heater 58 of the pressure roller 3*b* so that the surface temperature of the pressure roller 3*b* detected by the contact type thermistor 63 is a constant temperature below the prescribed temperature T1. Thus, during standby mode or power saving mode, the surface temperature of the heating roller 3*a* and the surface temperature of the pressure roller 3*b* in the full fixing region L are maintained at a constant temperature and power consumption of the fixing apparatus 3 is reduced.

Next, when a printing request occurs, the control section 55 performs ON/OFF control of the powering to the heater 58 of the pressure roller 3*b* in response to the surface temperature of the pressure roller 3*b* detected by the contact type thermistor 63 and raises the surface temperature of the pressure roller 3*b* to the prescribed temperature T1.

Furthermore, the control section 55 inputs the width of the sheet of recording paper from an external section and in response to that width it judges whether to carry out control of the powering of the main heater 53 and the sub-heater 54 of the heating roller 3*a* based on only the detection output of the non-contact type thermistor 61 or whether to carry out control of the powering of the main heater 53 and the sub-heater 54 of the heating roller 3*a* based on the detection output of the non-contact type thermistor 61 and the detection output of the contact type thermistor 62.

For example, when the sheet of recording paper is a standard B4 size and the sheet of recording paper passes a full fixing region L that is slightly narrower than the full width of the heating roller 3*a*, a judgment is made to carry out control of the powering based on only the detection output of the non-contact type thermistor 61 and when the sheet of recording paper is a standard A4 size and the sheet of recording paper passes the fixing region L1 that has a narrow width, a judgment is made to carry out control of the powering based on the detection output of the non-contact type thermistor 61 and the detection output of the contact type thermistor 62.

Then, if the sheet of recording paper is a standard B4 size and a judgment is made to carry out control of powering based on only the detection output of the non-contact type thermistor 61, the control section 55 determines the surface temperature t1 of the heating roller 3*a* in the fixing region L1 based on the detection output of the non-contact type thermistor 61 and controls the ON/OFF of the powering to both the main heater 53 and the sub-heater 54 of the heating roller 3*a* so that the surface temperature t1 becomes the prescribed temperature T1.

That is, when the sheet of recording paper is a standard B4 size and the sheet of recording paper passes the full fixing region L, control of the powering to both the main heater 53 and the sub-heater 54 is carried out based on the surface temperature t1 in the fixing region L1 indicated by the detection output of the non-contact type thermistor 61 such that the surface temperature t1 in the fixing region L1 is controlled at the prescribed temperature T1. Thus, the surface temperature t1 of the heating roller 3*a* becomes the prescribed temperature T1 in the full fixing region L.

Figure 6:
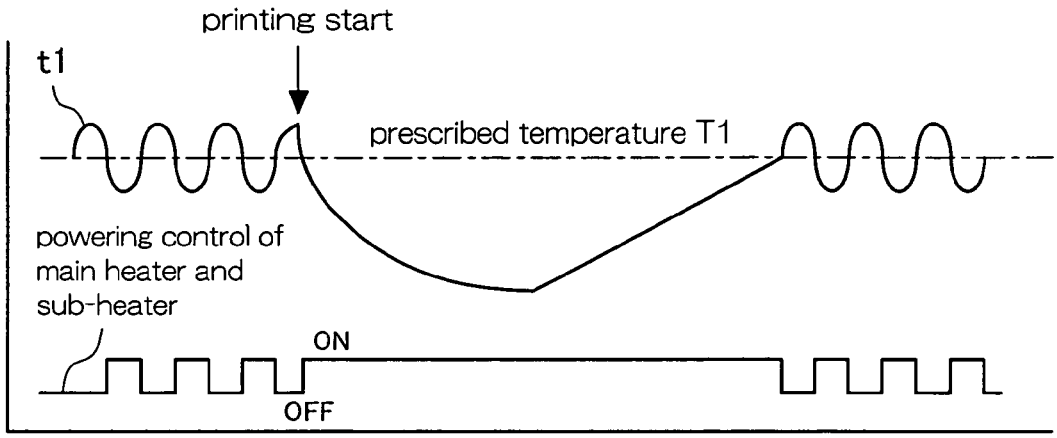
FIG. 6 is a timing chart showing control of powering of the main heater and the sub-heater and change in the surface temperature of the heating roller when a sheet of recording paper passes a full fixing region.

FIG. 6 is a timing chart showing control of powering of the main heater 53 and the sub-heater 54 and change in the surface temperature t1 of the heating roller 3*a* when the sheet of recording paper passes the full fixing region L. As shown in the timing chart, immediately prior to the start of printing, ON/OFF control of the powering to the main heater 53 and the sub-heater 54 is performed and the surface temperature t1 in the full fixing region L is substantially maintained at the prescribed temperature T1.

When printing starts, the sheet of recording paper passes through the nip region N between the heating roller 3*a* and the pressure roller 3*b*, and therefore an amount of heat of the heating roller 3*a* is lost due to the sheet of recording paper and the toner on the sheet of recording paper, such that the surface temperature t1 of the heating roller 3*a* corresponding to the detection output of the non-contact type thermistor 61 begins to fall. For this reason, continuous powering to the main heater 53 and the sub-heater 54 is performed and the surface temperature t1 rises to the prescribed temperature T1. Then, when the surface temperature t1 returns to the prescribed temperature T1, ON/OFF control of the powering to the main heater 53 and the sub-heater 54 is performed and the surface temperature t1 is again maintained at the prescribed temperature T1.

Figure 8:
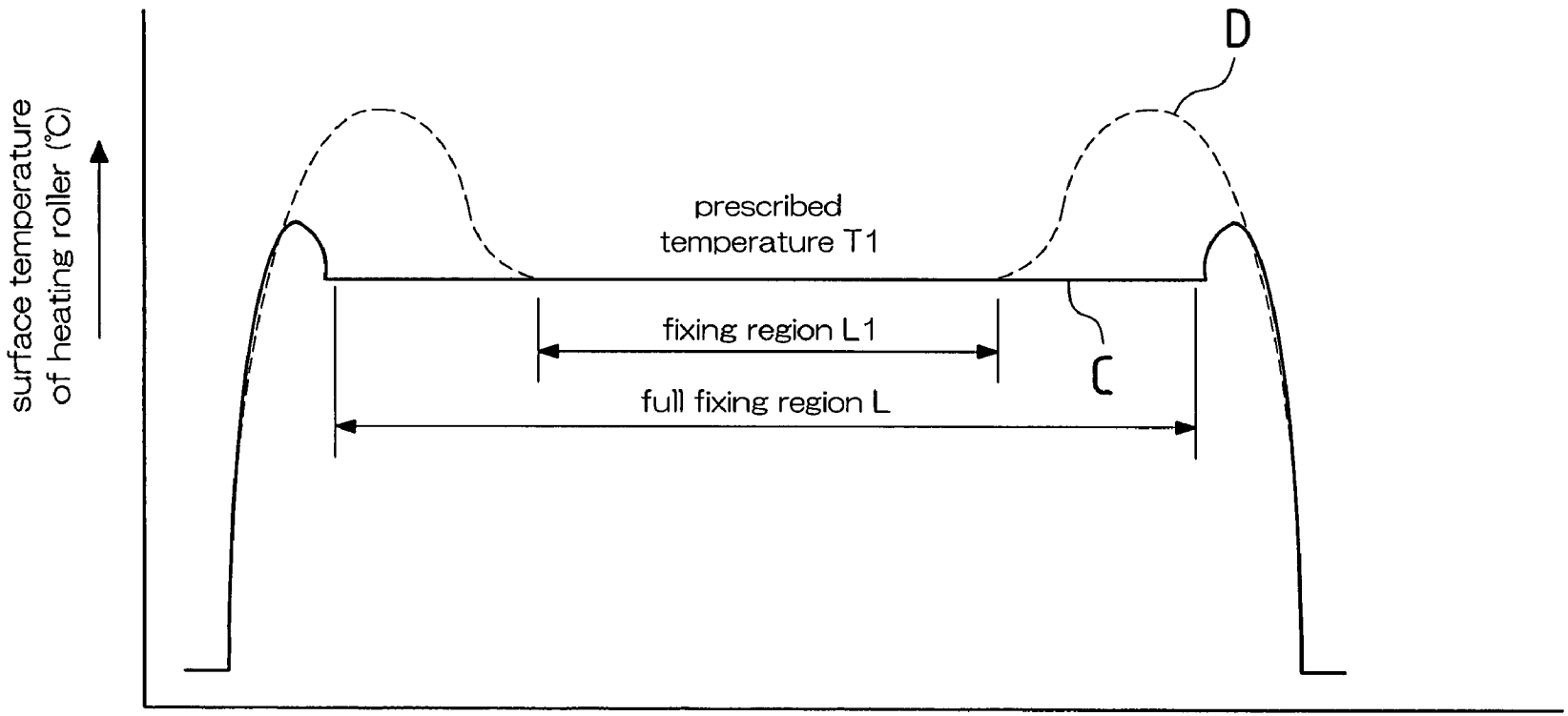
FIG. 8 is a graph showing a surface temperature distribution of the heating roller when a sheet of recording paper passes through a nip region between the heating roller and the pressure roller.

FIG. 8 is a graph showing a surface temperature distribution of the heating roller 3*a* when a sheet of recording paper passes through the nip region N between the heating roller 3*a* and the pressure roller 3*b*. When the sheet of recording paper passes the full fixing region L, the surface temperature t1 of any location of the full fixing region L is maintained at the prescribed temperature T1 as shown by a solid line C. However, although an amount of heat of the heating roller 3*a* is lost due to the sheet of recording paper and the toner on the sheet of recording paper in the full fixing region L, an amount of heat of the heating roller 3*a* is not lost at the outer sides of the full fixing region L, and therefore the heating roller 3*a* becomes overheated due to continuous powering to the main heater 53 and the sub-heater 54 and the surface temperature t1 becomes higher than the prescribed temperature T1.

Furthermore, if the sheet of recording paper is a standard A4 size and a judgment is made to carry out control of the powering based on the detection output of the non-contact type thermistor 61 and the detection output of the contact type thermistor 62, the control section 55 determines the surface temperature t1 of the heating roller 3*a* in the fixing region L1 from the detection output of the non-contact type thermistor 61 and controls the ON/OFF of powering to the main heater 53 so that the surface temperature t1 becomes the prescribed temperature T1, and also determines the surface temperature t2 of the heating roller 3*a* in the fixing regions L2 from the detection output of the contact type thermistor 62 and controls the ON/OFF of powering to the sub-heater 54 of the heating roller 3*a* so that the surface temperature t2 becomes the prescribed temperature T1.

That is, when the sheet of recording paper is a standard A4 size and the sheet of recording paper passes the fixing region L1 having a narrow width, in addition to the control of the powering to the main heater 53 of the heating roller 3*a* carried out based on the detection output of the non-contact type thermistor 61, control of the powering to the sub-heater 54 of the heating roller 3*a* is carried out based on the detection output of the contact type thermistor 62. Thus, the surface temperature t1 of the heating roller 3*a* in at least the fixing region L1 is controlled at the prescribed temperature T1.

Figure 7:
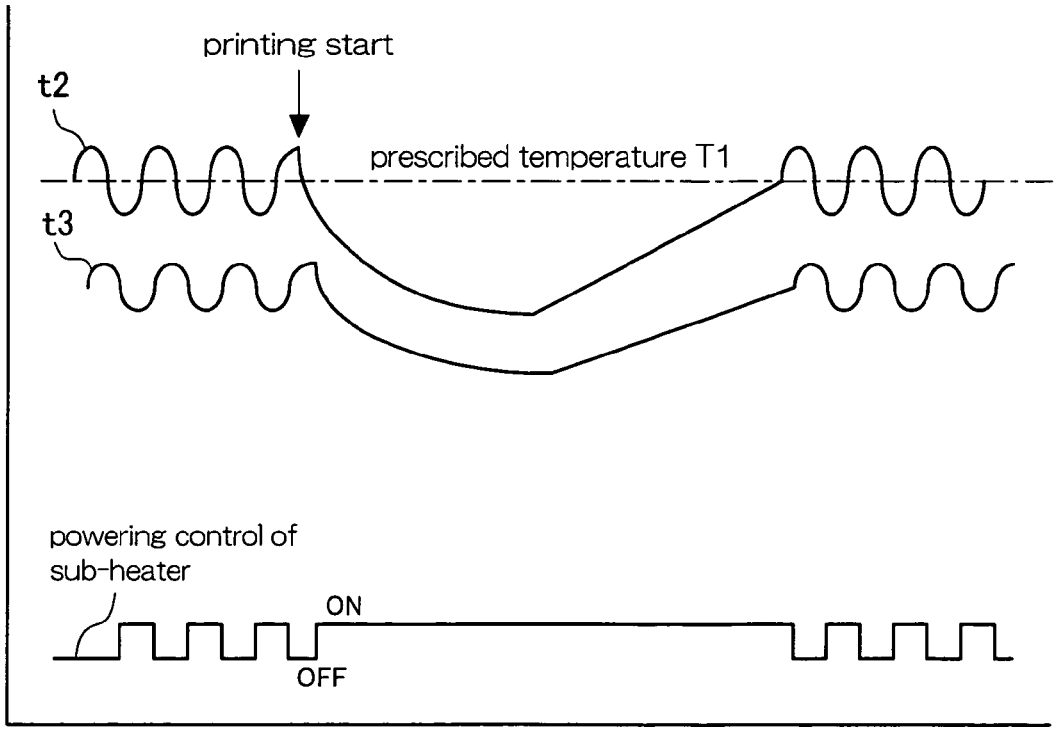
FIG. 7 is a timing chart showing control of powering of the sub-heater and change in the surface temperature of the heating roller when a sheet of recording paper passes a narrow width fixing region.

FIG. 7 is a timing chart showing control of powering of the sub-heater 54 and change in the surface temperature t1 when the sheet of recording paper passes the narrow width fixing region L1. As shown in the timing chart, immediately prior to the start of printing, ON/OFF control of the powering to the sub-heater 54 is performed and the surface temperature t2 in the fixing regions L2 is substantially maintained at the prescribed temperature T1. Furthermore, since the contact type thermistor 62 is arranged in contact with the end portion of the heating roller 3*a*, the surface temperature t3 of the end portion indicated by the detection output of the contact type thermistor 62 is delayed and follows the surface temperature t2.

The surface temperature t3 of the end portion falls delayed compared to the surface temperature t2, and therefore control of the powering to the sub-heater 54 is also delayed and as a result the surface temperature t2 in the fixing regions L2 is substantially maintained at the prescribed temperature T1.

Assuming that control of powering to the main heater 53 and the sub-heater 54 of the heating roller 3*a* was carried out based on only the detection output of the non-contact type thermistor 61 when the sheet of recording paper passes the narrow width fixing region L1, then as shown by a dashed line D in FIG. 8, even though the surface temperature t1 in the fixing region L1 can be held at the prescribed temperature T1, at the outer sides of the fixing region L1 an amount of heat of the heating roller 3*a* is not lost due to the sheet of recording paper and the toner, and therefore overheating of the heating roller 3*a* occurs due to continuous powering to the main heater 53 and the sub-heater 54 such that the surface temperature t2 becomes extremely higher than the prescribed temperature T1.

However, since control of the powering to the sub-heater 54 is carried out based on the detection output of the contact type thermistor 62, it is possible to avoid overheating of the heating roller 3*a* at the outer sides of the fixing region L1 and the surface temperature t1 can be maintained around the prescribed temperature T1. Moreover, the power consumption of the sub-heater 54 can be reduced.

In the fixing apparatus 3 according to the present embodiment, the non-contact type thermistor 61 in the fixing region L1 is arranged slightly apart from the surface of the elastic layer 52 of the heating roller 3*a*, and therefore there is no damage to the surface of the elastic layer 52. Furthermore, since the contact type thermistor 62 is arranged in contact with the end portion of the elastic layer 53 of the heating roller 3*a* away from the full fixing region L, and even if the end portion of the elastic layer 53 is damaged by contact with the contact type thermistor 62, damage to the end portion does not become a cause of unevenness of fixing on the sheet of recording paper.

Furthermore, since only one large non-contact type thermistor 61 is used in combination with the small contact type thermistor 62, it is possible to avoid increasing the size of the fixing apparatus 3 as well as the image forming apparatus 100.

It should be noted that the present invention is not limited to the above-described embodiment and includes other various variations. For example, one each of a non-contact type thermistor and a contact type thermistor were provided on the heating roller 3*a* but it is also possible to provide a larger number of non-contact type thermistors and contact type thermistors.

Furthermore, non-contact type thermistors and contact type thermistors may be provided not only on the heating roller 3*a* but on the pressure roller 3*b* as well.

The present invention can be embodied and practiced in other different forms without departing from the spirit and essential characteristics thereof. Therefore, the above-described examples are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A fixing apparatus provided with a roller for fixing and a plurality of heat sources that heat a surface of the roller, in which a surface temperature of the roller is detected and controlled at a prescribed temperature while a sheet of recording paper is subjected to pressure and heat by the roller to fix a developer onto the sheet of recording paper, comprising:

a plurality of temperature detection means for detecting the surface temperature of the roller, wherein the heat sources include a first heat source that heats a central area in a lengthwise direction of the roller and a second heat source that heats both sides of the central area of the roller;

wherein at least one of the temperature detection means is arranged in a first position of the roller that does not overlap any of the heat sources when viewed from a peripheral surface side of the roller;

wherein at least one of the temperature detection means is arranged in a second position away from a region of the roller to be controlled at the prescribed temperature, and wherein the fixing device further comprises control means for controlling the second heat source by performing correction on a temperature detected by the temperature detection means arranged in the second position, determining a temperature of a region of the roller to be controlled to the prescribed temperature, and controlling the second heat source based on the temperature determined by the correction.

2. The fixing apparatus according to claim 1, wherein the temperature detection means arranged at the second position is arranged in contact with the roller surface.

3. The fixing apparatus according claim 2, wherein the second position is a position away from a fixing region of a sheet of recording paper using the roller.

4. The fixing apparatus according to claim 1, wherein the second position is a position away from a fixing region of a sheet of recording paper using the roller.

5. The fixing apparatus according to claim 1, wherein the temperature detection means arranged at the region of the roller to be controlled to the prescribed temperature is arranged not contacting the roller surface.

6. The fixing apparatus according to claim 1, wherein the detected temperature at the second position is multiplied by a predetermined ratio $\alpha$.

7. A fixing device comprising:

a pair of fixing rollers composed of a heating roller and a pressure roller, first and second heat sources for heating a surface of the heating roller, wherein the first heat source heats a central area in a lengthwise direction of the heating roller and the second heat source heats both sides of the central area of the heating roller, a third heat source for heating a surface of the pressure roller, being arranged inside the pressure roller in the lengthwise direction of the pressure roller, a plurality of temperature detection means for detecting surface temperatures of the heating roller and the pressure roller, wherein at least one of the temperature detection means is arranged in a first position of the heating roller that does not overlap any of the heat sources when view from a peripheral surface side of the heating roller, wherein at least one of the temperature detections means is arranged in a second position away from a region of the heating roller to be controlled at a prescribed temperature, wherein the fixing device further comprises control means for controlling the second and third heat sources, wherein the second heat source is controlled based on a temperature determined by correction, the correction being performed on a temperature detected by the temperature detection means arranged in the second position, thereby determining a temperature of a region of the heating roller to be controlled to the prescribed temperature, and wherein the third heat source is controlled based on a temperature detected by the temperature detection means for detecting the surface temperature of the pressure roller such that the surface temperature of the pressure roller is kept at the prescribed temperature.

* * * * *